United States Patent [19]

Herbst et al.

[11] Patent Number: 4,863,585

[45] **Date of Patent: * Sep. 5, 1989**

[54] FLUIDIZED CATALYTIC CRACKING PROCESS UTILIZING A C3-C4 PARAFFIN-RICH CO-FEED AND MIXED CATALYST SYSTEM WITH SELECTIVE REACTIVATION OF THE MEDIUM PORE SILICATE ZEOLITE COMPONENT THEREOFO

[75] Inventors: Joseph A. Herbst, Turnersville; Hartley Owen, Belle Mead, both of N.J.; Paul H. Schipper, Wilmington, Del.

[73] Assignee: Mobil Oil Corporation, New York, N.Y.

[ * ] Notice: The portion of the term of this patent subsequent to Jan. 5, 2005 has been disclaimed.

[21] Appl. No.: 148,199

[22] Filed: Jan. 26, 1988

Related U.S. Application Data

[63] Continuation of Ser. No. 903,187, Sep. 3, 1986, abandoned.

[51] Int. Cl.[4] ..... C10G 11/04; C10G 37/02

[52] U.S. Cl. ..... 208/74; 208/75; 208/113; 208/157

[58] Field of Search ..... 208/74–78, 208/73, 153, 157, 144, 145, 111, 120, 57, 113; 472/140, 144

[56] References Cited

U.S. PATENT DOCUMENTS

| | | | |
|---|---|---|---|
| 3,617,497 | 11/1971 | Bryson et al. | 208/80 |
| 3,894,934 | 7/1975 | Owen et al. | 208/78 |
| 3,894,937 | 7/1975 | Bonacci et al. | 208/57 X |
| 4,422,925 | 12/1983 | Williams et al. | 208/120 |
| 4,490,241 | 12/1984 | Chou | 208/75 |
| 4,717,466 | 1/1988 | Herbst et al. | 208/113 |
| 4,749,470 | 6/1988 | Herbst et al. | 208/85 |
| 4,752,375 | 6/1988 | Herbst et al. | 208/74 |
| 4,787,967 | 11/1988 | Herbst et al. | 208/74 |

FOREIGN PATENT DOCUMENTS

| | | |
|---|---|---|
| 0074501 | 3/1983 | European Pat. Off. . |
| 0101553 | 1/1984 | European Pat. Off. . |
| 0171460 | 2/1986 | European Pat. Off. |
| 2298595 | 1/1975 | France . |

*Primary Examiner*—Glenn Caldarola

*Attorney, Agent, or Firm*—Alexander J. McKillop; Charles J. Speciale; Marina V. Schneller

[57] ABSTRACT

The present invention discloses a catalytic cracking process featuring at least one riser reactor, at least one stripping unit and at least one regenerator, which comprises:

(a) cracking a $C_{3-4}$ paraffin-rich feed in the lower section of the riser in the presence of the second component of a mixed catalyst system, the second component being zeolite Beta and/or a shape selective medium pore crystalline silicate zeolite, to provide light olefins and conversion products of light olefins including aromatics and hydrogen;

(b) cracking a heavy hydrocarbon feed in an upper section of the riser in the presence of the first component of the mixed catalyst system, the first component being an amorphous cracking catalyst and/or a large pore crystalline cracking catalyst, to provide gasoline boiling range components, there being a sufficient difference between one or more physical characteristics of the catalyst components as to permit particles of first catalyst component to be separated from particles of second catalyst component in the stripping unit;

(c) separating particles of spent first catalyst component from particles of second catalyst component in the stripping unit;

(d) stripping the separated particles of first catalyst component;

(e) conveying stripped, spent first catalyst component to the regenerator, the catalyst undergoing regeneration therein;

(f) conveying regenerated first catalyst component to the upper section of the riser;

(g) conveying stripped or non-stripped separated particles of second catalyst component to a reactivation zone, the catalyst undergoing reactivation therein; and, (h) conveying reactivated second catalyst component to the lower section of the riser.

25 Claims, 2 Drawing Sheets

FLUIDIZED CATALYTIC CRACKING PROCESS UTILIZING A C3-C4 PARAFFIN-RICH CO-FEED AND MIXED CATALYST SYSTEM WITH SELECTIVE REACTIVATION OF THE MEDIUM PORE SILICATE ZEOLITE COMPONENT THEREOFO

This is a continuation of copending application Ser. No. 903,187, filed on Sept. 3, 1986, abandoned.

BACKGROUND OF THE INVENTION

This invention relates to a catalytic cracking operation utilizing a $C_{3-4}$ paraffin-rich co-feed as a source of light olefins for subsequent conversion to gasoline boiling range components and further features the use of a mixed catalyst system comprising, as a first component, an amorphous cracking catalyst and/or a large pore crystalline cracking catalyst, e.g., zeolite Y, and, as a second component, zeolite Beta and/or a shape selective medium pore crystalline silicate zeolite catalyst, e.g., zeolite ZSM-5.

In known and conventional fluidized catalytic cracking processes, a relatively heavy hydrocarbon feedstock, e.g., a gas oil, admixed with a suitable cracking catalyst, e.g., a large pore crystalline silicate zeolite such as zeolite Y, to provide a fluidized suspension is cracked in an elongated reactor, or riser, at elevated temperature to provide a mixture of lighter hydrocarbon products. The gasiform reaction products and spent catalyst are discharged from the riser into a separator, e.g., a cyclone unit, located within the upper section of an enclosed stripping vessel, or stripper, with the reaction products being conveyed to a product recovery zone and the spent catalyst entering a dense catalyst bed within the lower section of the stripper. In order to remove entrained hydrocarbon product from the spent catalyst prior to conveying the latter to a catalyst regenerator unit, an inert stripping gas, e.g., steam, is passed through the catalyst where it desorbs such hydrocarbons conveying them to the product recovery zone. The fluidized catalyst is continuously circulated between the riser and the regenerator and serves to transfer heat from the latter to the former thereby supplying the thermal needs of the cracking reaction which is endothermic.

Particular examples of such catalytic cracking processes are disclosed in U.S. Pat. Nos. 3,617,497, 3,894,932, 4,309,279 and 4,368,114 (single risers) and U.S. Pat. Nos. 3,748,251, 3,849,291, 3,894,931, 3,894,933, 3,894,934, 3,894,935, 3,926,778, 3,928,172, 3,974,062 and 4,116,814 (multiple risers).

U.S. Pat. No. 3,894,932 describes a single riser fluid catalytic cracking operation in which a gas oil and a $C_{3-4}$-rich gaseous material is converted to aromatics and isobutane in the presence of a faujasite-type zeolite, e.g., zeolite Y.

U.S. Pat. No. 3,894,935 describes a dual riser fluid catalytic cracking process in which a gas oil is catalytically cracked in a first riser in the presence of a faujasite-type zeolite such as zeolite Y to provide gasoline boiling-range material and a $C_{3-4}$-rich hydrocarbon fraction or isobutylene is converted in a second riser in the presence of hot regenerated catalyst or catalyst cascaded thereto from the first riser to provide aromatics, alkyl aromatics and low boiling gaseous material.

Several of the processes referred to above employ a mixed catalyst system with each component of the system possessing different catalytic properties and functions. For example, in the dual riser hydrocarbon conversion process described in U.S. Pat. No. 3,894,934, a heavy hydrocarbon first feed, e.g., a gas oil, is cracked principally as a result of contact with a large pore crystalline silicate zeolite cracking catalyst, e.g., zeolite Y, to provide lighter products. Spent catalyst is separated from the product stream and enters the dense fluid catalyst bed in the lower section of the stripping vessel. A $C_{3-4}$ olefin-rich second feed, meanwhile, undergoes conversion to cyclic and/or alkylaromatic hydrocarbons in a second riser, principally as a result of contact with a shape selective medium pore crystalline silicate zeolite, e.g., zeolite ZSM-5. Spent catalyst recovered from the product stream of the second riser similarly enters the dense catalyst bed within the stripper vessel. U.S. Pat. No. 3,894,934 also features the optional introduction of a $C_3$-containing hydrocarbon third feed along with an aromatic-rich charge into the dense fluid bed of spent catalyst above the level of introduction of the stripping gas to promote the formation of alkyl aromatics therein. As desired, the third feed may be light gases obtained from a fluid cracking light ends recovery unit, virgin straight run naphtha, catalytically cracked naphtha, thermal naphtha, natural gas constituents, natural gasoline, reformates, a gas oil, or a residual oil of high coke-producing characteristics.

In this and other fluidized catalytic cracking operations employing mixtures of large and medium pore size crystalline silicate zeolite catalysts where catalyst separated from the product effluent is conveyed to a stripper and from there to a catalyst regenerating zone, regardless of the nature of the catalyst introduction at start-up, once steady-state operation has been achieved, the two types of catalyst will become fairly uniformly mixed and will circulate throughout the system at or about the same rate. This arrangement is subject to a significant disadvantage. While the large pore zeolite cracking catalyst cokes up relatively quickly and must therefore be regenerated at frequent intervals, this is not the case with the medium pore zeolite catalysts which can maintain their catalytic activity over many more cycles of operation. However, since the large and medium pore zeolite catalysts are in intimate admixture, heretofore there has been no practical means of conveying only the large pore zeolite catalyst to the catalyst regenerator unit or what amounts to the same thing, keeping the medium pore zeolite catalyst, or at least most of it, on the average out of the regenerator.

Thus, a principal disadvantage resulting from the use of mixed catalyst systems in known fluidized catalytic cracking operations is owing to the fact that the medium pore zeolite catalyst component is subjected to the harsh hydrothermal conditions of the catalyst regenerator unit even though it does not require regeneration anywhere near the rate at which the large pore zeolite cracking component must be regenerated. The medium pore zeolite catalyst is therefore needlessly subjected to hydrothermal deactivation at a much greater rate than is necessary for it to function.

In addition to the foregoing disadvantage, known catalytic cracking processes employing mixed catalyst systems are incapable of carrying out stripping and/or any other operation under conditions which differ for each catalyst component. While, for example, it might be advantageous to strip the spent large pore crystalline silicate zeolite cracking catalyst with steam and the medium pore crystalline silicate zeolite with hydrogen gas so as to also reactivate the latter, heretofore it has not been possible to accomplish this as both catalyst components remain substantially uniformly admixed throughout the entire catalytic cracking system.

U.S. Pat. No. 4,116,814 describes a multiple riser fluidized catalytic cracking operation utilizing a mixture of large and medium pore crystalline zeolite catalysts which differ in particle size and/or density as to facilitate their separation in a common catalyst regeneration unit. There is, however, no hint in this patent of preventing the transfer or reducing the rate of circulation of medium pore crystalline zeolite to and through the catalyst regeneration unit.

U.S. Pat. No. 4,287,088 describes a process and system for the segregation of used contaminated catalyst into fractions according to particle density differences. No mention is made of mixed catalyst systems.

SUMMARY OF THE INVENTION

It is an object of the invention to provide a catalytic cracking process for the conversion of a hydrocarbon charge stock to lighter products, e.g., gasoline, distillate and light olefins, employing a mixed catalyst system.

It is another object of the invention to provide a fluid catalytic cracking process in which a $C_{3-4}$ paraffin-rich co-feed is cracked in a riser reactor to provide light olefins and conversion products of light olefins including aromatics and hydrogen.

It is a particular object of the present invention to provide a catalytic cracking process featuring in cooperative association at least one riser reactor, at least one stripping unit and at least one catalyst regenerator and employing a mixed catalyst system comprising, as a first catalyst component, an amorphous cracking catalyst and/or a large pore crystalline cracking catalyst which requires relatively frequent regeneration and, as a second catalyst component, zeolite Beta and/or a shape selective medium pore crystalline silicate zeolite catalyst which requires regeneration less frequently than the first catalyst component, physical characteristic(s) of particles of first catalyst component differing sufficiently from physical characteristic(s) of particles of second catalyst component as to permit their separation within the stripping zone and subsequent transfer of the second catalyst component to a separate reactivation zone, the overall result being a reduction in the rate of circulation of the second catalyst component through the regeneration zone and a capability for efficiently and selectively reactivating the second catalyst component.

Yet another object of the invention consists in hydrotreating the heavy hydrocarbon feed prior to its introduction to the riser utilizing hydrogen recovered from the process.

In keeping with the foregoing objects, there is provided a catalytic cracking operation featuring at least one riser reactor, at least one stripping unit and at least one regenerator, which comprises:

(a) cracking a $C_{3-4}$ paraffin-rich feed in the lower section of the riser in the presence of the second component of a mixed catalyst system, the second component being zeolite Beta and/or a shape selective medium pore crystalline silicate zeolite, to provide light olefins and conversion products of light olefins including aromatics and hydrogen;

(b) cracking a heavy hydrocarbon feed in an upper section of the riser in the presence of both the first and second components of the mixed catalyst system, the first component being an amorphous cracking catalyst and/or a large pore crystalline cracking catalyst, to provide gasoline boiling range components, there being a sufficient difference between one or more physical characteristics of the catalyst components as to permit particles of first catalyst component to be separated from particles of second catalyst component in the stripping unit;

(c) separating particles of spent first catalyst component from particles of second catalyst component in the stripping unit;

(d) stripping the separated particles of first catalyst component;

(e) conveying stripped, spent first catalyst component to the regenerator, the catalyst undergoing regeneration therein;

(f) conveying regenerated first catalyst component to the upper section of the riser;

(g) conveying stripped or non-stripped separated particles of second catalyst component to a reactivation zone, the catalyst undergoing reactivation therein; and, (h) conveying reactivated second catalyst component to the lower section of the riser.

The term "catalyst" as used herein shall be understood to apply not only to a catalytically active material but to one which is composited with a suitable matrix component which may or may not itself be catalytically active.

The foregoing process possesses several significant advantages over known catalytic cracking operations. Thus, the cracking of the $C_{3-4}$ paraffin-rich feed in the lower section of the riser provides light olefins which subsequently undergo reactions characteristic of zeolite Beta and/or the shape selective medium pore crystalline silicate zeolite present therein, e.g., aromatization, alkylation, isomerization, oligomerization, etc., to provide components which contribute to an increase in the RON and MON of the gasoline product resulting from the cracking of heavy hydrocarbon feed further up the riser. The rapidly expanding catalyst-hydrocarbon suspension also acts as a lift medium for the suspension of catalyst and heavy hydrocarbon feed which is formed in the upper section of the riser.

In addition, the use of the foregoing mixed catalyst system does much to overcome a major drawback of known and conventional mixed catalyst systems in which both catalyst components circulate through the catalyst regeneration zone at about the same rate. As applied, for example, to a fluidized catalytic cracking process in which a cracking catalyst requiring frequent regeneration such as zeolite Y is employed in combination with zeolite Beta and/or a shape selective medium pore crystalline silicate zeolite catalyst requiring comparatively infrequent regeneration such as ZSM-5, the present invention makes it possible to sustain relatively high levels of activity of the latter catalyst for much longer average periods than would otherwise be the case due to the reduced incidence of its exposure to the catalyst-degrading environment of the regenerator zone. This, in turn, permits the refiner to take greater advantage of the unique catalytic capabilities of zeolite Beta and/or ZSM-5 in a catalytic cracking operation.

In addition to the foregoing advantage, the process of this invention makes it possible to strip the spent cracking catalyst with steam while separately reactivating, or simultaneously reactivating and stripping, zeolite Beta and/or the shape selective medium pore crystalline silicate zeolite catalyst with a reactivating/stripping gas such as hydrogen.

DESCRIPTION OF THE PREFERRED EMBODIMENTS

Figure 1:
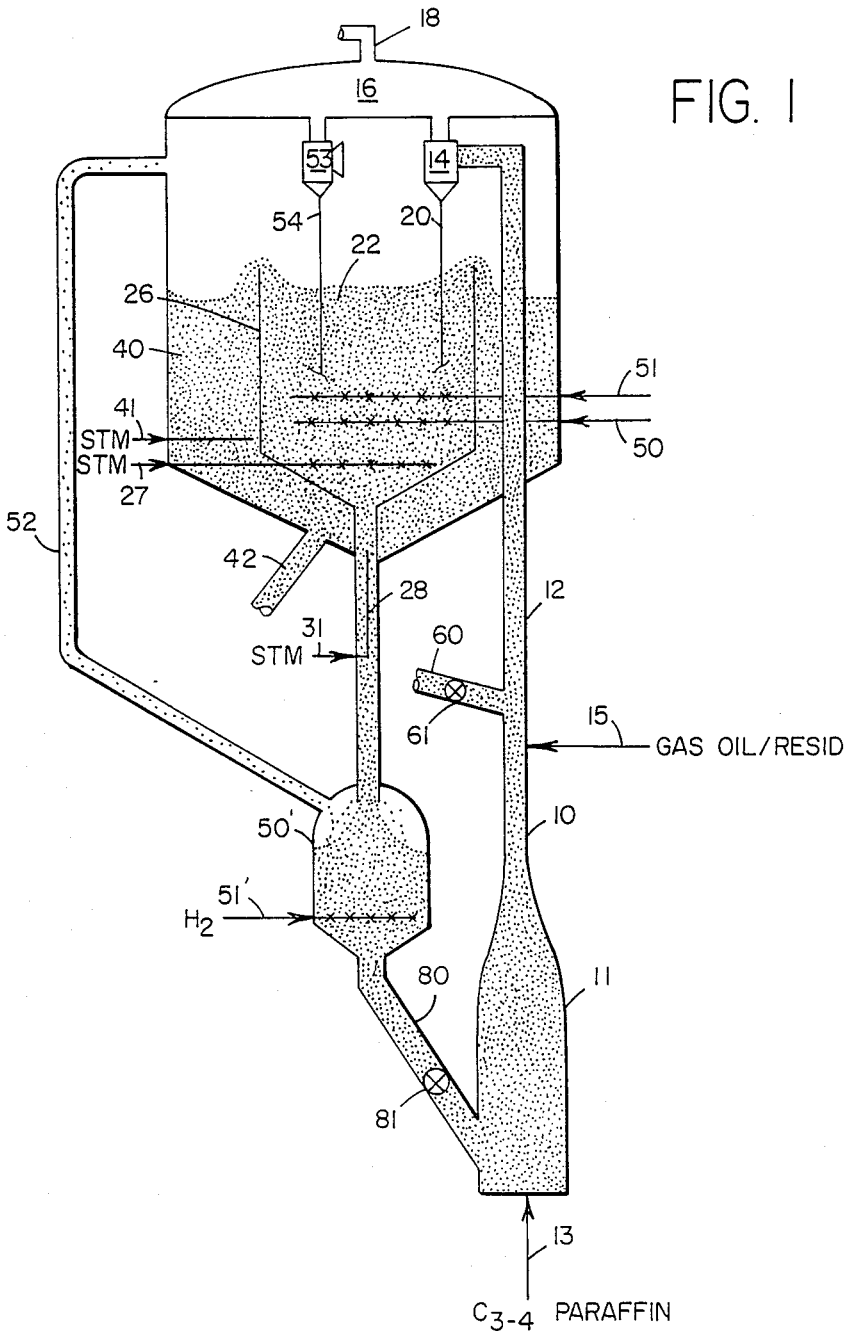
FIGS. 1 and 2 schematically illustrate preferred embodiments of a fluidized catalytic cracking process in accordance with this invention, i.e., one in which the second catalyst component defines a zone of concentration in an expanded, lower section of the riser reaction zone and the stripping zone features means for separating the first and second catalyst components based primarily on differences in their average particle sizes and densities, such arrangement making it possible to both cycle the second catalyst component without exposing it to the catalyst-degrading conditions of the regenerator zone and selectively reactivate the second catalyst medium with a suitable reactivating medium such as hydrogen, a hydrogen-rich gas and/or a hydrogen-rich hydrocarbon.

Conventional cracking catalyst components are generally amorphous silica-alumina and crystalline silica-alumina. Other materials said to be useful as cracking catalysts are the crystalline silicoaluminophosphates of U.S. Pat. No. 4,440,871 and the crystalline metal aluminophosphates of U.S. Pat. No. 4,567,029.

However, the major conventional cracking catalysts presently in use generally comprise a large pore crystalline silicate zeolite, generally in a suitable matrix component which may or may not itself possess catalytic activity. These zeolites typically possess an average crystallographic pore dimension of about 7.0 Angstroms and above for their major pore opening. Representative crystalline silicate zeolite cracking catalysts of this type include zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,314,752), merely to name a few, as well as naturally occurring zeolites such as chabazite, faujasite, mordenite, and the like. Also useful are the silicon- substituted zeolites described in U.S. Pat. No. 4,503,023. Zeolite Beta is yet another large pore crystalline silicate which can constitute a component of the mixed catalyst system utilized herein.

It is, of course, within the scope of this invention to employ two or more of the foregoing amorphous and/or large pore crystalline cracking catalysts as the first catalyst component of the mixed catalyst system. Preferred crystalline zeolite components of the mixed catalyst system herein include the natural zeolites mordenite and faujasite and the synthetic zeolites X and Y with particular preference being accorded zeolites Y, REY, USY and RE-USY and mixtures thereof.

The shape selective medium pore crystalline silicate zeolite catalyst constituting the second catalyst component of the mixed catalyst system is exemplified by ZSM-5, ZSM-11, ZSM-12, ZSM-23, ZSM-35, ZSM-38, ZSM-48 and other similar materials. U.S. Pat. No. 3,702,886 describing and claiming ZSM-5 is incorporated herein by reference. Also, U.S. Reissue Pat. No. 29,948 describing and claiming a crystalline material with an X-ray diffraction pattern of ZSM-5 is incorporated herein by reference as is U.S. Pat. No. 4,061,724 describing a high silica ZSM-5 referred to as "silicalite" therein.

ZSM-11 is more particularly described in U.S. Pat. No. 3,709,979, the entire contents of which are incorporated herein by reference.

ZSM-12, is more particularly described in U.S. Pat. No. 3,832,449, the entire contents of which are incorporated herein by reference.

ZSM-23 is more particularly described in U.S. Pat. No. 4,076,842, the entire contents of which are incorporated herein by reference.

ZSM-35 is more particularly described in U.S. Pat. No. 4,016,245, the entire contents of which are incorporated herein by reference.

ZSM-38 is more particularly described in U.S. Pat. No. 4,046,859, the entire contents of which are incorporated herein by reference.

ZSM-48 is more particularly described in U.S. Pat. No. 4,375,573, the entire contents of which are incorporated herein by reference.

The preferred shape selective medium pore crystalline silicate zeolite components of the mixed catalyst system herein are ZSM-5, ZSM-11, ZSM-12, ZSM-23, ZSM-35, ZSM-38 and ZSM-48 with ZSM-5 being particularly preferred.

In general, the aluminosilicate zeolites are effectively employed herein. However, zeolites in which some other framework element which is present in partial or total substitution of aluminum can be advantageous. For example, such catalysts may provide a higher conversion of feed to aromatic components, the latter tending to increase the octane, and therefore the quality, of the gasoline produced in the process. Illustrative of elements which can be substituted for part or all of the framework aluminum are boron, gallium, zirconium, titanium and any other trivalent metal which is heavier than aluminum. Specific examples of such catalysts include ZSM-5 and zeolite Beta containing boron, gallium, zirconium and/or titanium. In lieu of, or in addition to, being incorporated into the zeolite framework, these and other catalytically active elements can also be deposited upon the zeolite by any suitable procedure, e.g., impregnation. It is also within the scope of this invention to employ a mixed catalyst system in which the first component contains a large pore zeolite cracking catalyst such as zeolite Y and the second component contains zeolite Beta, advantageously one containing boron, gallium, zirconium and/or titanium as part of its framework structure and/or deposited thereon.

Separation of particles of first catalyst component from particles of second catalyst component in the stripping unit can be accomplished in several ways. For example, the two components can be provided in such different average particle sizes that they can be readily sorted within a stripping unit possessing suitable sieving means, an arrangement more particularly described in connection with the single riser fluidized catalytic cracking unit illustrated in FIG. 1, infra.

Figure 2:
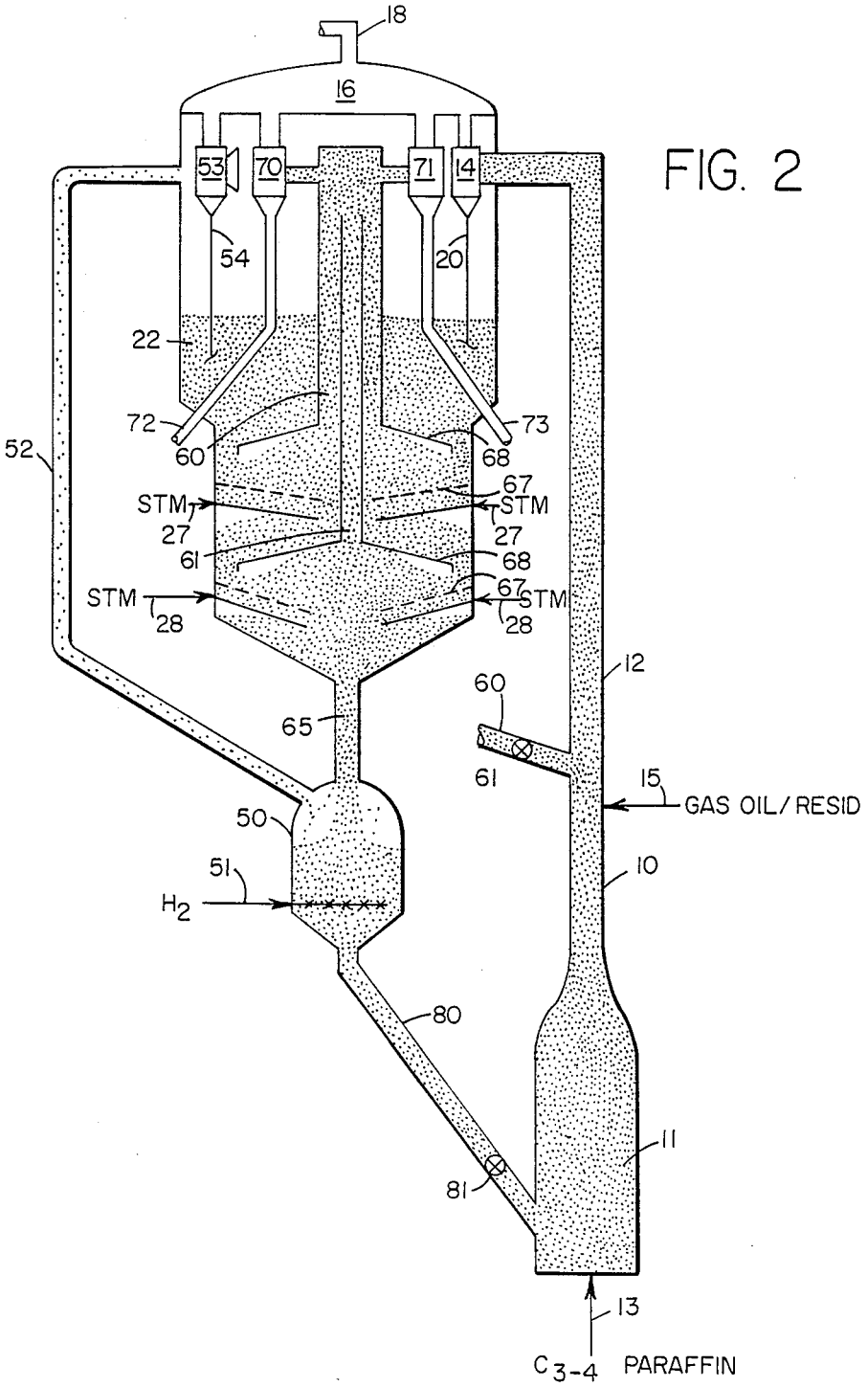

Separation within the stripping zone can also be achieved by classifying the first and second catalyst components according to their average particle densities which can be made to be significantly different in various ways including by appropriate selection of the matrix components with which they are composited as more fully explained below. In general, smaller, less dense catalyst particles will tend on the average to define an upper phase within the stripper floating upon larger, more dense catalyst particles which, conversely, will tend on the average to define a lower phase within the stripper.

Where separation of catalyst particles is based largely on differences in density, several techniques can be used to effect their separation including the use of a lift medium, e.g., steam to separate less dense catalyst particles from more dense catalyst particles and convey the former to a separate region of the stripper, such being described more fully, infra, in connection with the stripping unit embodiments shown in FIGS. 1 and 2.

It is, of course, within the scope of this invention to effect separation of catalyst particles either before or after carrying out a stripping operation thereon.

Once their separation into different regions of the stripper has been accomplished, the particles of second catalyst component, i.e., zeolite Beta and/or the shape selective medium pore crystalline silicate zeolite, are conveyed to a reactivation zone supplied with a suitable reactivating medium, e.g.,hydrogen or hydrogen-rich gas, where reactivation of the catalyst occurs under known and conventional conditions, e.g., a temperature of from about 800° F. to about 1500° F. or even higher and preferably at from about 1000° F. to about 1400° F. Preferably, the hydrogen is introduced into the reactivation zone at a temperature which is somewhat higher than that of the resident catalyst so as to improve the efficiency of any stripping taking place therein. This can be readily accomplished by preheating the hydrogen by exchange with hot regenerated catalyst or flue gas from the regenerator. The gaseous effluent of the reactivation operation can be combined with the other product gases. The particles of second catalyst component may or may not have been stripped at the time of their transfer to the reactivation zone. In the case of the latter, the reactivation operation also serves to desorb hydrocarbonaceous material entrained by the catalyst particles.

In a preferred embodiment of this invention, the characterizing physical properties of the first and second catalyst components are so selected that they each will exhibit different settling rates, designated $R_1$ and $R_2$ respectively, which permit the catalyst particles having the greater settling rate, in this case the second catalyst component, to remain on average within the lower region of the riser longer than the catalyst particles having the lower settling rate, i.e., longer than the particles of first catalyst component. Residency time of catalyst particles in a riser is primarily dependent on two factors: the linear velocity of the fluid stream within the riser which tends to carry the entire catalyst bed/conversion products/unconverted feed up and out of the riser into the separator unit and the opposing force of gravity which tends to keep the slower moving catalyst particles within the riser. Ordinarily, in a mixed catalyst system, both catalyst components will circulate through the system at about the same rate. As previously pointed out, this has proven disadvantageous to the other catalyst component which does not require as frequent regeneration as the large pore zeolite cracking catalyst will be needlessly subjected to the catalyst-degrading conditions of the regenerator with the result that its useful catalytic life will be shortened. However, in accordance with this invention, it is possible to retain the less coke deactivated zeolite Beta and/or shape selective medium pore crystalline silicate zeolite catalyst within the riser, even to the point where, because of a balance between the upward velocity of this catalyst component and its settling rate, it can be made to remain more or less stationary within the lower region of the riser defining a zone of concentration therein. To bring about this balance or to otherwise prolong the residency time of the second component of the mixed catalyst system within the lower region of the riser, the average density, particle size and/or shape of the catalyst particles can be adjusted in a number of ways as to provide the desired settling characteristics. As a general guide, as the average particle size of the catalyst increases and/or its average particle density increases, the residency time of the catalyst will increase.

Assuming, for example, this differential in $R_1$ and $R_2$ is accomplished by making the particles of the second catalyst component initially larger and of greater density than the particles of first catalyst component and perhaps even more irregular in shape than the latter, gradual attrition of the larger particles (through particle collision) will progressively reduce their capability for prolonged residency in the riser and as time goes on, increasing quantities of such particles will enter the stripping zone where, however, they can still be readily separated based on their different densities as later more fully explained. This arrangement, i.e., increased residency time in the riser coupled with separation in the stripping zone, maximizes the capability of the catalytic cracking process of this invention for reducing the rate of circulation of the less coke deactivated and/or hydrothermally stable catalyst particles through the regenerator zone.

Among the techniques which can be used for making one catalyst component more dense than the other is compositing each catalyst with a matrix component of substantially different density. Useful matrix components include the following:

| matrix component | particle density (gm/cm$^3$) |
|---|---|
| alumina | 3.9–4.0 |
| silica | 2.2–2.6 |
| magnesia | 3.6 |
| beryllia | 3.0 |
| barium oxide | 5.7 |
| zirconia | 5.6–5.9 |
| titania | 4.3–4.9 |

Combinations of two or more of these and/or other suitable porous matrix components, e.g., silica-alumina, silica-magnesia, silica-thoria, silica-alumina-zirconia, etc., can be employed for a still wider spectrum of density values from which one may select a specific predetermined value as desired.

In general, selection of each matrix component will be such that the catalyst which is to have the lower rate of circulation through the regenerator will be more dense than the catalyst requiring frequent regeneration. For example, in the case of a mixed catalyst system containing medium pore and large pore crystalline silicate zeolites where it is desired to increase the residency time of the medium pore zeolite catalyst in the lower region of the riser, the overall packed density of the medium pore zeolite catalyst particles inclusive of its matrix component can advantageously vary from about 0.6 to about 4.0 gm/cm$^3$, and preferably from about 2.0 to about 3.0 gm/cm$^3$, and the overall packed density of the large pore zeolite catalyst particles inclusive of its matrix component can advantageously vary from about 0.4 to about 1.1 gm/cm$^3$ density, and preferably from about 0.6 to about 1.0 gm/cm$^3$.

Another useful technique for adjusting the density of each catalyst component, again in the case of a mixture of medium and large pore zeolites, is to composite the medium pore zeolite catalyst particles with a material which tends to coke up faster than the particles of large pore zeolite catalyst, such resulting in an increase in the density of the former in situ. Illustrative of such materials is hydrated alumina which in situ forms a transition alumina which has a rapid coking rate. This embodiment possesses several additional advantages. In the coked-up state, the composited medium pore silicate zeolite catalyst is more resistant to attrition which results from collision with other particles in the riser. The individual catalyst particles can sustain more collisions and thus serve as a practical means of adjusting the velocity of the large pore zeolite catalyst particles through the riser (the latter in colliding with the medium pore zeolite particles will, as a result, have reduced velocity) In addition, the coked-up composited medium pore zeolite catalyst particles will tend to accumulate metals present in the feed.

As previously stated, the relative settling rate of each catalyst component can be selected by varying the average particle size of the catalyst particles. This can be readily accomplished at the time of compositing the catalyst particles with various matrix components. As between two catalyst components of significantly different average particle size, the larger will tend to remain within the riser longer than the smaller. Where, as here, it is desired to increase the residency time of the medium pore zeolite catalyst particles in the first riser over that of the large pore zeolite catalyst component, the average particle size of the former will usually be larger than that of the latter. So, for example, the average particle size of the medium pore zeolite catalyst particles can be made to vary from about 500 microns to about 70,000 microns, and preferably from about 100 to about 25,000 microns while the average particle size of the large pore zeolite catalyst particles can be made to vary from about 20 to about 150 microns, and preferably from about 50 to about 100 microns.

The shape, or geometric configuration, of the catalyst particles also affects their relative settling rates, the more irregular the shape (i.e., the more the shape deviates from a sphere), the longer the residency time of the particles in the riser. Irregular-shaped particles can be simply and readily achieved by crushing the catalyst-matrix extrudate or using an extruded catalyst.

As will be appreciated by those skilled in the art, the settling rate for a particular catalyst component will result from the interaction of each of the three foregoing factors, i.e., density, average particle size and particle shape. The factors can be combined in such a way that they each contribute to the desired result. For example, the particles of the less coke deactivated second catalyst component can simultaneously be made denser, larger and more irregular in shape than the first catalyst particles which require relatively frequent regeneration. However, a differential settling rate can still be provided even if one of the foregoing factors partially offsets another as would be the case where greater density and smaller average particle size coexist in the same catalyst particle. Regardless of how these factors of particle density, size and shape are established for a particular catalyst component, their combined effect will, of course, be such as to result in a significant differential in settling rates of the components comprising the mixed catalyst system of this invention.

By expanding, or flaring, the lower region of the riser, it is possible to further prolong the residency time thereof of the denser, larger and/or more irregularly shaped particles of first catalyst component which, as previously stated, will define a zone of concentration therein.

Zeolite Beta and/or the shape selective medium pore crystalline silicate zeolite catalyst can be present in the mixed catalyst system over widely varying levels. For example, the zeolite concentration of the second component can be present at a level as low as about 0.01 to about 1.0 weight percent of the total catalyst inventory (as in the case of the catalytic cracking process of U.S. Pat. No. 4,368,114) and can represent as much as 25 weight percent of the total catalyst system.

The $C_{3-4}$ paraffin-rich feed can be provided from any suitable source, e.g., the product of a high temperature catalytic cracking operation, petroleum fractionation, natural gas, etc.

Suitable charge stocks for cracking in the upper section of the riser comprise the heavy hydrocarbons generally and, in particular, petroleum fractions having an initial boiling point range of at least 400° F., a 50% point range of at least 500° F. and an end point range of at least 600° F. Such hydrocarbon fractions include gas oils, thermal oils, residual oils, cycle stocks, whole top crudes, tar sand oils, shale oils, synthetic fuels, heavy hydrocarbon fractions derived from the destructive hydrogenation of coal, tar, pitches, asphalts, hydrotreated feedstocks derived from any of the foregoing, and the like. As will be recognized, the distillation of higher boiling petroleum fractions above about 750° F. must be carried out under vacuum in order to avoid thermal cracking.

FIGS. 1 and 2 each describes the stripping section of a single riser fluidized cracking unit provided with means for separating particles of ZSM-5 catalyst from particles of zeolite Y catalyst based primarily upon the difference in the densities of these two types of catalyst components. The riser component of the fluidized cracking units shown in FIGS. 1 and 2 is of a preferred type, i.e., the lower region thereof is expanded, or outwardly flared, so as to alter the linear velocity of the fluid stream in this region. The purpose of this feature, as previously stated, is to further prolong the residency time of the ZSM-5 catalyst particles, which are both larger and of greater density than the zeolite Y particles, in the lower region of the riser. Thus, the ZSM-5 particles occupying this region possess a combination of density, average particle size and perhaps even shape such that the linear velocity of the suspension in this region which would tend to carrying the ZSM-5 particles up and out of riser is in approximate balance with the settling rate of these particles. Such being the case, the ZSM-5 particles, or at least the bulk of them, remain more or less stationary in lower region 11 of riser 10 where they selectively react the $C_{3-4}$ or $C_{3-7}$ paraffin-rich feed to light olefins and catalyze a variety of conversions involving the light paraffins and olefins present in this region including oligomerization, alkylation, isomerization, aromatization, etc., the result of which, as previously indicated, is to contribute to the production of a gasoline product of increased RON and MON. Spent particles of zeolite Y catalyst, being less dense, smaller and/or more regular in shape than the ZSM-5 particles, continue past lower region 11 and, together with the conversion products from said lower region and some amount of ZSM-5 particles, enter upper region 12 of the riser where they are combined with hot, freshly regenerated zeolite Y and a gas oil/resin feed. The gasiform products of all of the conversion reactions occurring in riser 10 are ultimately discharged from the top of the riser into one or more cyclonic separation zones adjacent the riser discharge as represented by cyclone separator 14 provided with dipleg 20.

Although as indicated earlier, the ZSM-5 particles have an initially greater average particle size and density than that of the zeolite Y particles and therefore can be made to form a zone of concentration in flared lower region 11 of riser 10, eventually they will become reduced in size due to the inevitable particle collisions which constantly take place in the system. As time goes on, more and more of the ZSM-5 catalyst particles will be discharged from riser 10 to enter catalyst bed 22 where, however, their higher density compared to the zeolite Y particles permits them to be separated by a variety of arrangements, two of which are shown in FIGS. 1 and 2.

Referring to FIG. 1, there is shown a riser reactor 10 provided with a mixture of $C_3$ and $C_4$ paraffins introduced into lower region 11 through conduit 13. The feed combines with stripped catalyst transferred directly from the lower region of catalyst bed 22 located within the stripping zone to the bottom of riser 10 through conduit 80 provided with flow control valve 81. The stripped catalyst contains a relatively high proportion of ZSM-5 particles. The conversion conditions within lower region 11 of riser 10 can be varied depending upon whether it is desired to maximize production of aromatics and hydrogen or less aromatics and hydrogen but more light olefins (for a higher overall liquid yield). When it is desired to emphasize the production of aromatics, the ZSM-5 zeolite in the second catalyst component can represent from about 0.01 to about 25, and preferably from about 1 to about 10, weight percent of the total catalyst mixture in this region and the temperature can range from about 1100° to about 1500° F. and preferably from about 1250° to about 1350° F., the catalyst to feed ratio can range from about 50:1 to about 200:1 and preferably from about 100:1 to about 150:1 and the catalyst contact time can range from about 10 to about 50 seconds and preferably from about 15 to about 35 seconds. When, however, light olefin production (at the expense of naphtha) is desired, the conditions of ZSM-5 catalyst concentration, temperature, catalyst to feed ratio and/or catalyst contact time can be less severe than the aforementioned ranges.

A heavy hydrocarbon feed, e.g., a gas oil and/or resid, is introduced further up riser 10 in region 12 thereof through conduit 15 and combines with the ascending catalyst-hydrocarbon vapor suspension from lower region 11. The transfer of varying amounts of hot, regenerated zeolite Y from the regenerating zone through conduit 60 provided with flow control valve 61 permits regulation of the zeolite Y concentration in upper region 12 of the riser and assists in maintaining control of the temperature therein. Zeolite Y concentration can range from about 2 to about 50, preferably from about 5 to about 25, weight percent, the temperature can range from about 900° to about 1150° F. and preferably from about 925° to about 1050° F., the catalyst to heavy hydrocarbon feed ratio can range from about 3:1 to about 20:1 and preferably from about 4:1 to about 10:1 and the catalyst contact time can range from about 0.5 to about 30 seconds and preferably from about 1 to about 15 seconds. During passage of the suspension through the upper section of the riser, conversion of the heavy hydrocarbon feed to lower boiling products occurs. The catalyst-hydrocarbon suspension ultimately passes to cyclone separator 14 which separates catalyst particles from gases, the former entering catalyst bed 22 via dipleg 20 and the latter entering plenum chamber 16 for transfer through conduit 18 to a downstream product separation facility (not shown). Vessel 26 which occupies an approximately central region of the stripping zone is provided with a source of stripping gas, e.g., steam, supplied through conduit 27 in the lower section thereof. The particles of ZSM-5 catalyst, being of greater average density than the zeolite Y particles, tend to gravitate toward and concentrate at the bottom of vessel 26 and, following stripping, to enter return conduit 28 provided with a source of low pressure steam 31 which blows smaller, less dense particles of zeolite Y which may have become entrained with the ZSM-5 particles back up into catalyst bed 22. The ZSM-5 particles are then introduced to reactivation vessel 50' which, as previously indicated, can also operate as a stripper. Vessel 50' is supplied with hydrogen or a hydrogen-rich gas through line 51'. Reactivation takes place under known conditions as stated above, the gaseous effluent together with some quantity of catalyst particles being conveyed through line 52 to cyclone separator 53 which separates the stream into gaseous material passing to plenum chamber 16 and catalyst which passes to catalyst bed 22 via dipleg 54. Reactivated ZSM-5 catalyst particles, meanwhile, are conveyed through line 80 equipped with valve 81 to the bottom of riser 10 as previously indicated.

In the meanwhile, the ascending current of stripping gas and desorbed hydrocarbonaceous material from the stripper acts as a lift medium tending to carry lower density particles of zeolite Y out of vessel 26 into an outer peripheral region 40 the lower section of which is provided with its own supply of stripping gas, again, e.g., steam, through conduit 41. Stripping gas and other gasiform material is separated from catalyst particles in cyclone separator 53, the formed passing to plenum chamber 16 and the latter entering catalyst bed 22 via dipleg 54. Stripped, spent zeolite Y continues its downward flow movement and is withdrawn from the stripper through conduit 52 where it is conveyed to a regenerator (not shown) which is operated in a conventional or otherwise known fashion.

In order to enhance the overall efficiency of the operation, a light olefin feed, e.g., a gas rich in ethylene and/or propylene, can be introduced into catalyst bed 22 in the lower region thereof through conduit 50 to produce higher weight products and an exotherm which improves the desorption efficiency of the stripper operation. In general, the quantity of light olefin feed should be such as to increase the temperature of the catalyst bed in this region by at least about 50° F., and preferably by at least about 100° F. To accomplish this, from about 0.5 to about 20, and preferably from about 1 to about 10, weight percent of light olefin feed can be introduced into this phase by weight of total catalyst present in the stripper.

Ordinarily, then, the temperature of catalyst bed 22 will increase from its usual range of about 880°–1150° F. to about 930°–1250° F. and even higher. This increase in spent catalyst bed temperature significantly enhances the stripping, or desorption, of hydrocarbons and, where present, sulfur compounds, which are entrained by the catalyst particles. It is possible to increase the recovery of such entrained hydrocarbons by from about 5 to about 30 weight percent or more compared to substantially the same stripping procedure carried out in the absence of the exothermic conversion reaction herein. Optionally, where the light olefin feed in line 50 is predominantly made up of ethylene, one or more other highly reactive light olefins, e.g., propylene, butylene or mixtures thereof, can be introduced into the lower region of catalyst bed 22 through a separate conduit 51 in order to take advantage of the higher partial pressure of the ethylene contained in the feed stream introduced through line 50 located therebelow. Amounts of $C_3$ and/or $C_4$ olefin material ranging from about 0.1 to about 5, and preferably from about 0.2 to about 3, weight percent of the entire catalyst bed can be suitably employed.

It is advantageous to utilize hydrogen recovered from the foregoing cracking operation in the hydrotreating of the gas oil/resid charge stock, especially where the latter contains fairly high quantities of metal contaminants and/or sulfur-containing material. Thus, hydrogen recovered from a gas plant operation is conveyed to a hydrotreating unit supplied with a gas oil/resid feed and operated in accordance with conventional or otherwise known conditions in the presence of suitable hydrotreating catalysts, e.g., cobalt and molybdenum oxides on alumna, nickel oxide, nickel thiomolybdat, tungsten and nickel sulfides and vanadium oxide. The hydrotreated gas/oil resid at elevated temperature is conveyed through conduit 15 to riser 10 as previously described.

The embodiment of the process shown in FIG. 2 is essentially like that described in connection with FIG. 1 except for the manner in which the comparatively denser particles of ZSM-5 are separated from the zeolite Y particles in the stripping zone. Descending catalyst bed 22 situated within an outer region of the stripping zone encounters streams of stripper gas, e.g., steam, introduced through conduits 27 and 28 which tends to lift the less dense particles of zeolite Y up concentrically arranged vertical conduits 60 and 61, respectively. The more dense particles of ZSM-5 catalyst continue to flow downwardly where they eventually enter return conduit 80 for return to riser 10. The source of stripping gas is advantageously placed below perforated baffles 67 so that the gas tends to force the less dense zeolite Y catalyst particles against baffles 68, the latter guiding the flow of the zeolite Y catalyst particles up conduits 60 and 61. The upper section of conduits 60 and 61 lead to one or more cyclone separators 70 and 71 which convey the separated spent zeolite Y particles through conduits 72 and 73 to the regenerator (not shown).

From the foregoing, it will be appreciated that due to the separation of ZSM-5 catalyst particles from zeolite Y catalyst particles in the stripper and, optionally, the comparatively prolonged residency time of particles one of the catalyst components in the riser (preferably the ZSM-5 component), it is possible to have much of the ZSM-5 catalyst bypass the regenerator altogether. As a result, the ZSM-5 catalyst particles are retained in the catalyst inventory at relatively high levels of activity therein for a longer average period of time than would be the case were the circulation rate of the ZSM-5 catalyst particles the same as or similar to that of the zeolite Y catalyst particles. In addition, separation of the ZSM-5 catalyst particles from the zeolite Y catalyst particles makes it possible to efficiently reactivate the latter in a separate reactivation zone.

Having thus provided a general discussion of the present invention and described specific embodiments in support thereof, it is to be understood that no undue restrictions are to be imposed by reason thereof except as provided by the following claims.

What is claimed is:

1. A catalytic cracking process featuring at least one riser reactor, at least one stripping unit and at least one regenerator, which comprises:

(a) catalytically cracking a $C_3$–$C_4$ paraffin-rich feed in the lower section of said riser wherein the catalyst in the lower section of the riser consists of a second component of a mixed catalyst system, the second component being selected from the group consisting of zeolite Beta, shape selective medium pore crystalline silicate zeolite and admixtures thereof, to provide light olefins and conversion products of light olefins including aromatics and hydrogen;

(b) cracking a heavy hydrocarbon feed in an upper section of the riser in the presence of both the first and second component of the mixed catalyst system, the first component being at least one member selected from the group consisting of an amorphous cracking catalyst and a large pore crystalline cracking catalyst, to provide gasoline boiling range components, there being a sufficient difference between one or more physical characteristics of the catalyst components as to permit particles of first catalyst component to be separated from particles of second catalyst component in the stripping unit, said heavy hydrocarbon having an initial boiling rang of at least 400° F., a 50% point range of at least 500° F. and an end point range of at least 600° F.;

(c) separating particles of spent first catalyst component from particles of second catalyst component in the stripping unit;

(d) stripping the separated particles of first catalyst component;

(e) conveying stripped, spent first catalyst component to the regenerator, the catalyst undergoing regeneration therein;

(f) conveying regenerated first catalyst component to the upper section of the riser;

(g) conveying stripped or non-stripped separated particles of second catalyst component to a reactivation zone, the catalyst undergoing reactivation therein; and, (h) conveying reactivated second catalyst component to the lower section of the riser.

2. The process of claim 1 wherein physical characteristic(s) of particles of first and second catalyst components are such that the particles differentiate within the stripping unit into an upper phase made up mostly of particles of one catalyst component and a lower phase made mostly of particles of the other catalyst.

3. The process of claim 2 wherein the upper phase is made up mostly of first catalyst component and the lower phase is made up mostly of second catalyst component.

4. The process of claim 3 wherein the particles of first catalyst component are on the average smaller and/or of less density than the particles of second catalyst component.

5. The process of claim 2 wherein the upper phase is made up mostly of second catalyst component and the lower phase is made up mostly of first catalyst component.

6. The process of claim 5 wherein the particles of second catalyst component are on the average smaller and/or of less density than the particles of first catalyst component.

7. The process of claim 1 wherein the difference between the average particle size of the first and second catalyst components is such as to permit their separation within the stripping unit by sieving.

8. The process of claim 7 wherein the average particle size of the first catalyst component is greater than that of the second catalyst component.

9. The process of claim 7 wherein the average particle size of the second catalyst component is greater than that of the first catalyst component.

10. The process of claim 1 wherein the difference between the average particle densities of the first and second catalyst components are such as to permit their separation within the stripping unit with a counter-current stream of lift medium which separates catalyst component of lesser average particle density from the remainder of the descending catalyst particles carrying the former into a separate region of the stripping unit.

11. The process of claim 10 wherein the counter-current stream of lift medium separates particles of catalyst component of lesser average particle density from the remainder of the descending catalyst particles contained within the central region of the stripping unit and carries the former into a separate peripheral region of the stripping unit.

12. The process of claim 11 wherein the lift medium is steam.

13. The process of claim 11 wherein the average particle density of the first catalyst component is greater than that of the second catalyst component.

14. The process of claim 11 wherein the average particle density of the second catalyst component is greater than that of the first catalyst component.

15. The process of claim 10 wherein the counter-current stream of lift medium separates particles of catalyst component of lesser average particle density from the remainder of the descending catalyst particles containing within an outer region of the stripping unit and carries the former into a separate central region of the stripping unit.

16. The process of claim 15 wherein the lift medium is steam.

17. The process of claim 1 wherein the first catalyst component is an amorphous and/or large pore crystalline cracking catalyst having a settling rate $R_1$ and the second catalyst component is zeolite Beta and/or a shape-selective medium pore crystalline silicate zeolite having a settling rate $R_2$ which is sufficiently different from $R_1$ as to permit one of the catalyst components to remain within the reaction zone for a longer period than the other catalyst component.

18. The process of claim 17 wherein the settling rate of the second catalyst component is greater than the settling rate of the first catalyst component.

19. The process of claim 17 wherein the average particle size and/or density of the second catalyst component is larger than the average particle size and/or density of the first catalyst component and/or the shape of the second catalyst component particles is more irregular than the shape of the first catalyst component particles.

20. The process of claim 18 wherein the average particle size of the first catalyst component ranges from about 20 to about 150 microns and the average particle size of the second catalyst component ranges from about 500 to about 70,000 microns, and/or the average packed density of the first catalyst component ranges from about 0.4 to about 1.1 $gm/cm^3$ and the average packed density of the second catalyst component ranges from about 0.6 to about 4.0 $gm/cm^3$.

21. The process of claim 20 wherein the average particle size of the first catalyst component ranges from about 50 to about 100 microns and the average particle size of the second catalyst component ranges from about 1000 to about 25,000 microns, and/or the average packed density of the first catalyst component ranges from about 0.6 to about 1.0 $gm/cm^3$ and the average packed density of the second catalyst component ranges from about 2.0 to about 3.0 $gm/cm^3$.

22. The process of claim 19 wherein the second catalyst component is composited with a matrix material which imparts a significantly greater density to said component compared to the density of the first catalyst component.

23. The process of claim 22 wherein the second catalyst component is composited with a matrix material which possesses a coking rate which is higher than the coking rate of the matrix of the first catalyst component.

24. The process of claim 18 wherein the lower region of the riser is outwardly flared so as to prolong the residency of the second catalyst component therein.

25. The process of claim 1, wherein said heavy hydrocarbon feed is selected from the group consisting of gas oils, resids, and admixtures thereof.

* * * * *